US006186839B1

(12) United States Patent
Storey et al.

(10) Patent No.: US 6,186,839 B1
(45) Date of Patent: Feb. 13, 2001

(54) ELECTRICAL CONNECTOR

(75) Inventors: William T. Storey, Dalmatia; Wesley H. Snyder, Halifax, both of PA (US)

(73) Assignee: W. T. Storey Inc., Dalmatia, PA (US)

( * ) Notice: Under 35 U.S.C. 154(b), the term of this patent shall be extended for 0 days.

(21) Appl. No.: 09/513,666

(22) Filed: Feb. 25, 2000

(51) Int. Cl.[7] ..... H01R 4/36
(52) U.S. Cl. ..... 439/812; 439/811
(58) Field of Search ..... 439/812, 811, 439/792, 793

(56) References Cited

U.S. PATENT DOCUMENTS 2,201,674 * 5/1940 Rowe et al. ..... 439/812
2,222,156 * 11/1940 Rowe ..... 439/812

FOREIGN PATENT DOCUMENTS

0449152 * 3/1935 (GB) ..... 439/812

OTHER PUBLICATIONS

McMaster–Carr Supply Company Catalog 104 Split–Bolt Splices, p. 1, Lines 17–20; date 1998.

* cited by examiner

*Primary Examiner*—Steven L. Stephan
*Assistant Examiner*—Phuong Dinh
(74) *Attorney, Agent, or Firm*—Thomas R. Shaffer, Esq

(57) ABSTRACT

An electrical connector is disclosed which has a terminal block having threaded screw opening provided in a first surface thereof. The screw opening has a pair of longitudinally extending groves on opposite sides of a cylindrical side wall of the screw opening. The terminal block also has a cable opening on a surface adjacent the first surface. The cable opening extends longitudinally into the screw opening. A screw member is provided having a threaded outer surface. The screw member is provided with a generally diamond shaped compression member which is rotatably mounted to a shaft provided on the first end of the screw member. The diamond shaped compression member has two rounded corners provided on a long axis of the member in such a manner that when the first end of the screw member is inserted into the screw opening, the two rounded corners of the compression member slide in and are guided by the longitudinally extending groves as the screw member is threaded into the screw hole. As a result, the diamond shaped compression member is moved only longitudinally (axially) onto a cable inserted in the cable opening compressing exposed wires of the cable between the compression member and a bottom surface of the screw opening.

11 Claims, 4 Drawing Sheets

ELECTRICAL CONNECTOR

BACKGROUND OF THE INVENTION

1. Field of the Invention

The present invention relates to an electrical connector. More specifically, it relates to a pressure screw connector utilized to securely connect an electrical cable to a terminal block without damaging the exposed wire ends of the electrical cable.

2. Description of the Prior Art

A variety of prior art pressure screw connectors have been proposed to connect an electrical cable to a terminal block. However, such devices typically involve a screw which when tightened, compresses the exposed wires of the cable between the screw end and the bottom of a screw opening in the terminal block. Such systems may damage the exposed wires because of the rotational force imparted to the wires by the rotating screw. While some systems do exist which prevent rotational force being imparted to the wires, such as, for example, a split bolt, such systems typically are limited to a particular wire gauge or to a narrow range of wire sizes. Therefore, there remains a need for a connector which can be utilized on a wide range of wire sizes (both solid and stranded) which imparts only an axial force upon the wires and which does not impart any rotational force which could damage the wires.

SUMMARY OF THE INVENTION

An electrical connector is disclosed which comprises a terminal block having threaded screw opening provided in a first surface thereof. The screw opening has a pair of longitudinally extending groves on opposite sides of a cylindrical side wall of the screw opening. The terminal block also has a cable opening on a surface adjacent said first surface. The cable opening extends longitudinally into said screw opening.

A screw member is provided having a threaded outer surface. A first end of the screw member is adapted to be received by the threaded screw opening. The screw member is provided with a generally diamond shaped compression member which is rotatably mounted to a shaft provided on said first end of the screw member. The diamond shaped compression member has two rounded corners provided on a long axis of the member, whereby when a cable is inserted into the cable opening and the first end of the screw member is inserted into the screw opening, the two rounded corners of the compression member slide in and are guided by said longitudinally extending groves as the screw member is threaded into said screw hole. As a result, the diamond shaped compression member is moved only longitudinally (axially) onto said cable compressing exposed wires of the cable between the compression member and a bottom surface of the screw opening. Such action secures the cable in the terminal block with the diamond compression block restrained against rotation during rotation of said screw.

Preferably, the generally diamond shaped compression member also has two additional corners provided on a short axis of the member which freely pass through the screw opening when the screw member is threaded into the screw opening.

The terminal block preferably includes a socket contact in the form of a female pin receptacle electrically connected to said terminal block.

The screw member preferably has a second end which has a hexagonal opening therein adapted to receive a hex key wrench.

The connector of the present invention is preferably utilized to make an electrical connection between an electrical cable and various types of information technology equipment.

In an alternate form of the invention, the generally diamond shaped compression member has a generally circular shape with said two rounded corners in the form of tabs extending on opposite sides of said member. As used herein, the term generally diamond shaped is intended to include such a structure.

Preferably, the cable opening has a plurality of concentric groves provided therein to aid in securing the cable is said terminal block. Further, the bottom of the screw opening is preferably generally flat and has a plurality of transverse groves provided therein to aid in securing the cable is said terminal block.

Preferably, the diamond shaped compression member is rotatably attached to said shaft by means of a drive screw or, alternatively, by a rivet.

In the preferred embodiment of the invention, said terminal block and said diamond shaped compression member are formed of tin plated copper and said screw is formed of stainless steel.

DETAILED DESCRIPTION OF THE PREFERRED EMBODIMENTS

Figure 1:
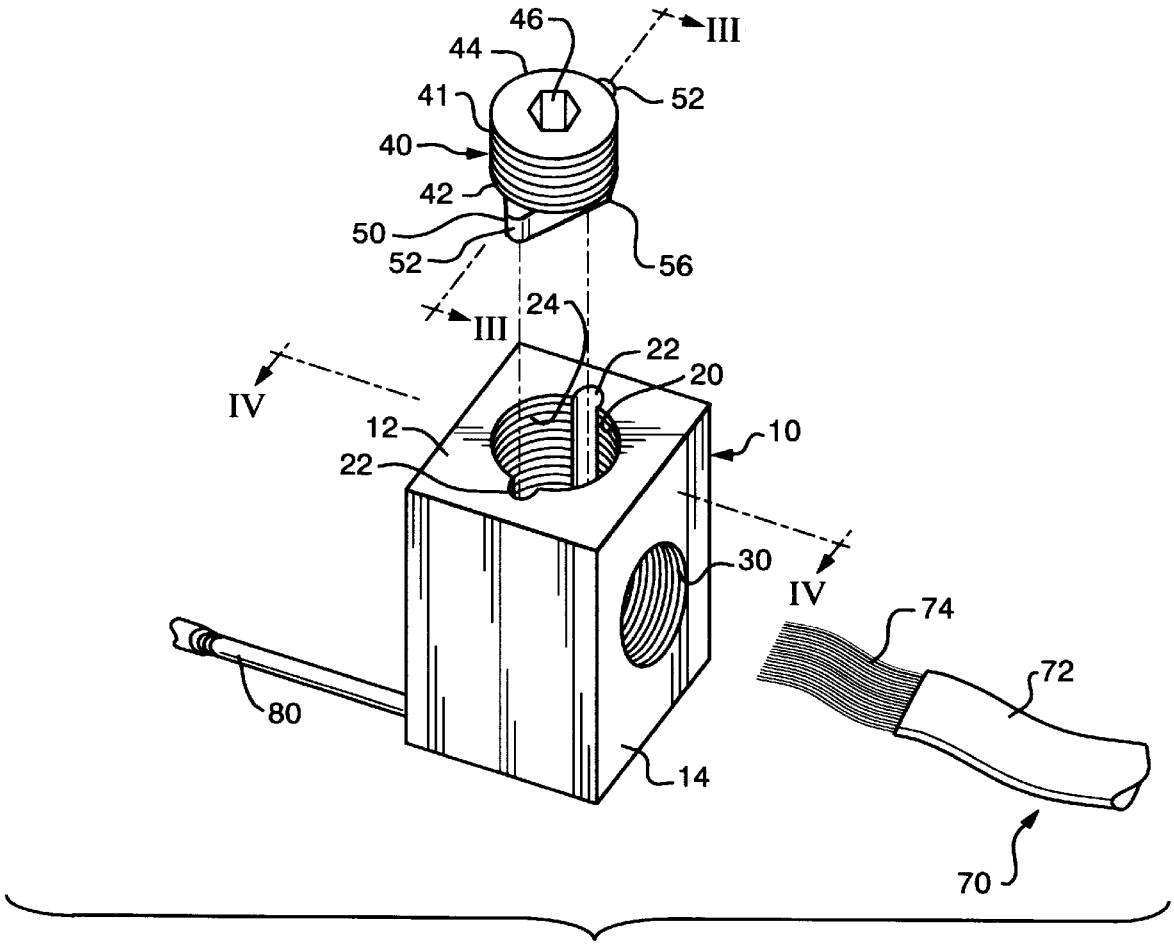
FIG. 1 is an isometric view in exploded form of the preferred embodiment of the electrical connector of the present invention showing the terminal block, the screw member and a cable.

The preferred embodiment of the present invention is shown in FIGS. 1–5 and 7. Referring to these figures, a terminal block 10 is provided which has a threaded screw opening 20 provided in a first surface 12 thereof. The screw opening 20 has a pair of longitudinally extending grooves 22 provided on opposite sides of a threaded cylindrical wall 24 of the screw opening 20. The terminal block 10 also has a cable opening 30 on a surface 14 which is adjacent said first surface 12. The cable opening 30 extends longitudinally into the screw opening 20. A screw member 40 is provided which has a threaded outer surface 41 which is adapted to be received by the threaded cylindrical side wall 24 of said screw opening 20. The screw member 40 has a first end 42 which is adapted to be received by the threaded screw opening.

The screw member 40 also has a generally diamond shaped compression member 50 rotatably mounted to a shaft 44 provided on said first end 42. The diamond shaped compression member 50 has two rounded corners 52 provided on a long axis 54 of the member. The compression member also has two corners 56 provided on a short axis 58 of the member. The corners 56 are adapted to freely pass through the screw opening 20 when the screw member is threaded into the screw opening. In use, a cable 70 is inserted into the cable opening 30 and the first end 42 of the screw member 40 is inserted into the screw opening 20. The two rounded corners 52 of the diamond shaped compression member 50 are received by the grooves 22 in the screw opening 20. It will be obvious to those skilled in the art that such grooves allow the compression member to move longitudinally (axially) into the screw opening but prevent the diamond shaped compression member from rotating during rotation of the screw member 40. When the cable 70 is inserted into said cable opening and the first end of the screw member is inserted into said screw opening, said two rounded corners 52 of the compression member 50 slide in and are guided by said longitudinally extending grooves 24 as the screw member 40 is threaded into the screw hole 20 such that the diamond shaped compression member 50 is moved only longitudinally onto said cable compressing said cable between the compression member 50 and the bottom surface 26 of the screw opening 20.

Figure 7:
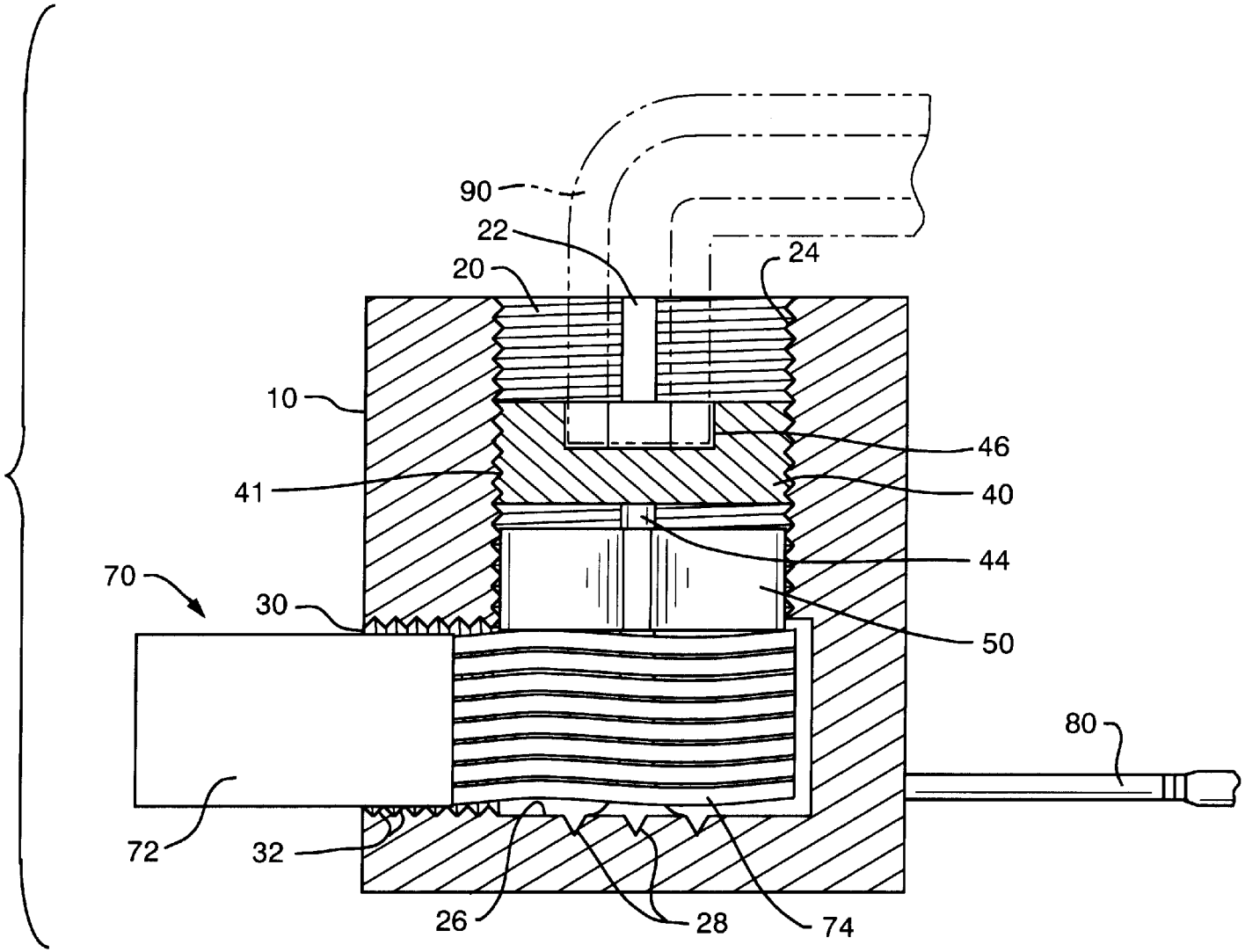
FIG. 7, is an isometric view of the connector of the present invention as fully assembled with a cable secured therein.

As can be best seen by FIG. 1, the present invention is best suited for use with an electrical cable 70 which has an outer sheathing 72. When the outer sheathing 72 is removed from an end of the cable 70, a plurality of fine electrical conducting wires are exposed. If the diameter of the individual exposed wires 74 are large, a rotational force imparted upon them generally does not cause any serious damage or harm to the wires. However, when the electrical wires 74 are relatively fine, the application of a rotational force by a screw member of prior art devices upon the wires can deform and damage the individual wires. Thus, the present invention is best suited for cables having fine wires 74, although it will work perfectly well with wires of any diameter. In a preferred embodiment of the invention, the screw member 40 has a hexagonal recess 46 therein adapted to receive hex key wrench 90 (FIG. 7).

Preferably, a female pin receptacle 80 is electrically connected to the terminal block. This female receptacle is adapted to receive a male pin of various information technology equipment or other electrical devices. It will be obvious to those skilled in the art that any form of receptacle or plug could be connected or attached to the terminal block 10.

Figure 2:
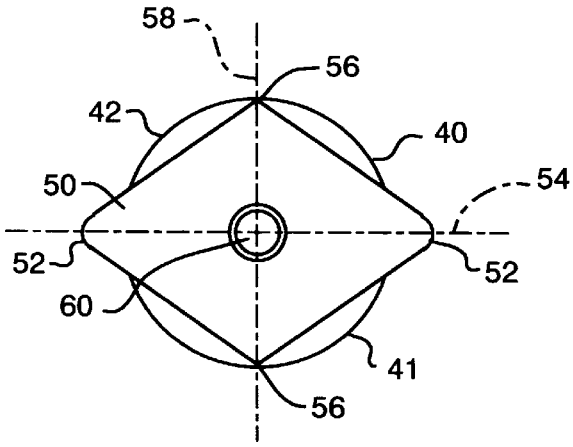
FIG. 2, is a bottom plan view of the screw member of FIG. 1.
Figure 5:
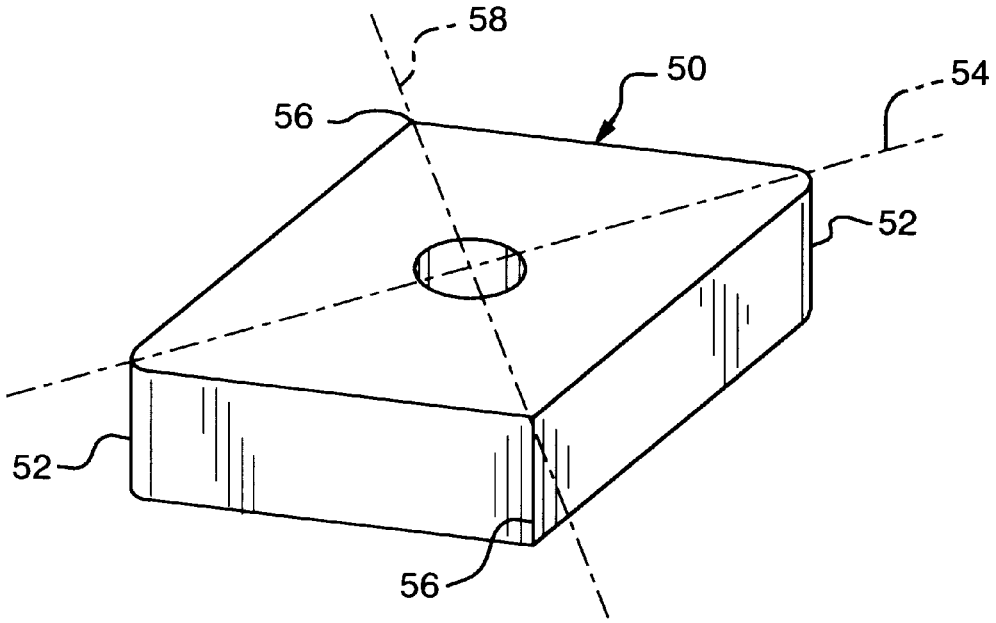
FIG. 5, is an isometric view of the preferred embodiment of the generally diamond shaped compression member of the present invention.
Figure 6:
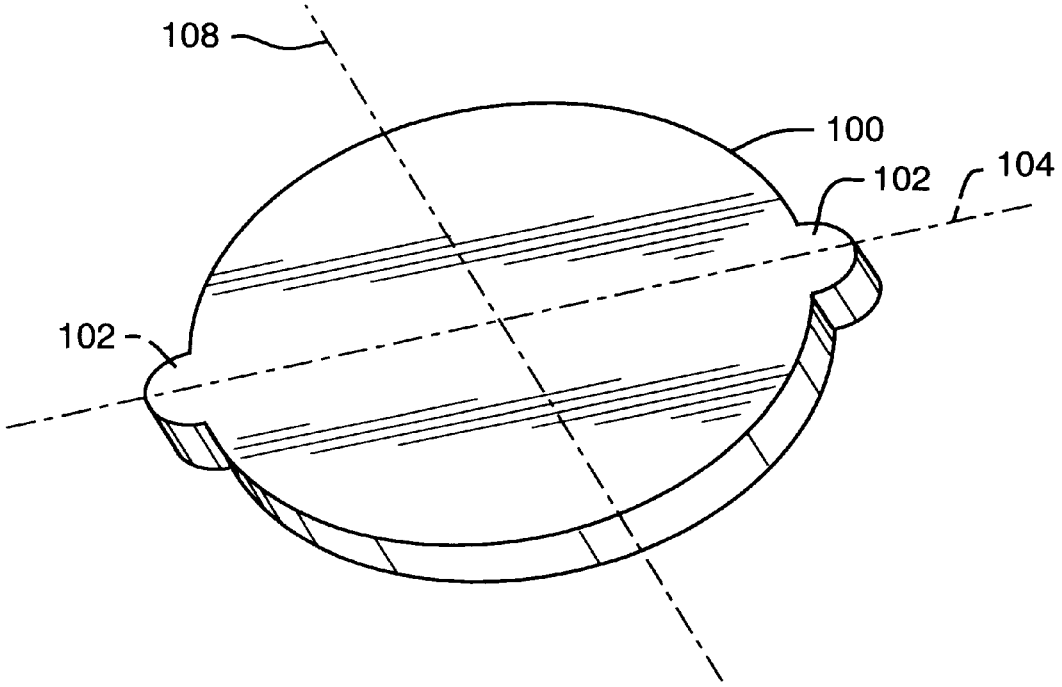
FIG. 6, is an isometric view of an alternate embodiment of the diamond shaped compression member of the present invention.

Referring to FIG. 2, the diamond shaped compression member 50 is shown attached to the screw member 40 by means of a drive screw 60. FIG. 5 shows the preferred embodiment of the compression member 50 of the present invention. FIG. 6 shows an alternate embodiment of a compression member for use with the present invention. In FIG. 6, a generally circular compression member is provided which has tabs 102 provided along a long axis 104 thereof. No tabs are provided along a short axis 108 of the compression member of FIG. 6. The embodiment of FIG. 5 is preferred because the diamond shape makes manufacturing the device less costly and more efficient.

Figure 3:
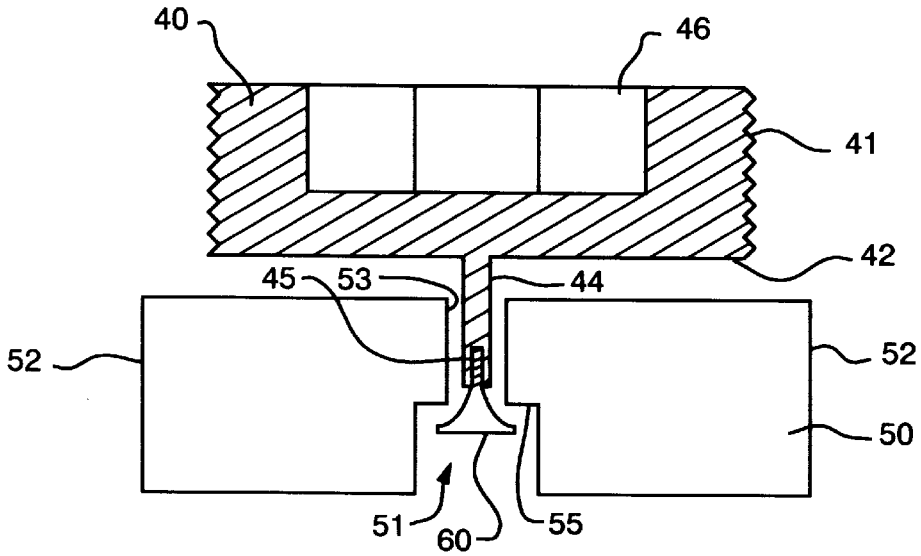
FIG. 3, is a cross sectional view of the screw member of the present invention taken on the line III—III of FIG. 1.

Referring to FIG. 3, a cross sectional view of the screw member 40 of the present invention is shown. The thread member 40 has a recess 46 therein adapted to be received by a hex key wrench. The screw member has a threaded outer cylindrical surface 41 and has a shaft 44 provided on end 42 thereof. The end of shaft 44 is hollow and is adapted to receive a drive screw 60. The drive screw 60 is utilized to attach and rotatably secure the diamond shaped compression member 50 thereto. While the use of a drive screw is presently preferred, an alternate means of a attaching the compression member 50 to the screw member 40 is contemplated wherein end 45 of shaft 40 is formed to be hollow such that end 45 can be spun or peened out to function as a rivet (which is essentially integrally formed on the end 45 of shaft 44).

As shown in FIG. 3, the diamond shaped compression member has an opening through the center thereof which is comprised of a narrow opening 53 on the end of the compression member which faces the screw member 40 and a larger opening 51 on an opposite end thereof. This structure provides a retaining surface 55 which contacts the drive screw 60 if the diamond shaped compression member is moved axially away from the screw member 40. This arrangement allows the compression member 50 to freely rotate relative to the screw member 40 and vice versa.

Figure 4:
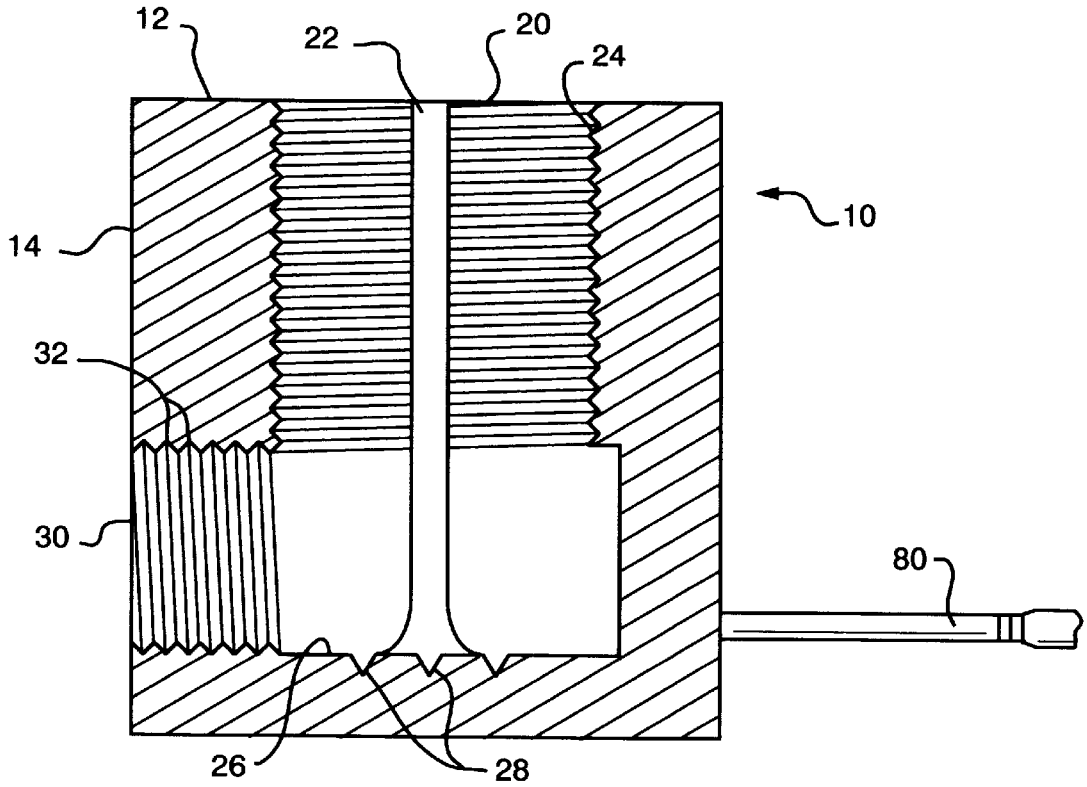
FIG. 4, is a cross sectional view of the terminal of the present invention taken on the line IV—IV of FIG. 1.

FIG. 4 shows a cross sectional view of the terminal block of the present invention and shows screw opening 20 having a threaded cylindrical inner surface 24 and a longitudinal groove 22 therein. The bottom surface 26 of screw opening 20 is generally flat and is provided with grooves 28 to aid in retaining exposed conductor wires 74 in the terminal block. The cable opening 30 is also preferably provided with grooves 32 which also aid in retaining the wires 74 in the terminal block.

Finally, FIG. 7 shows the connector of the present invention in a fully assembled form with the compression member 50 compressing the wires 74 between the compression member 50 and the bottom 26 of the screw opening 20.

While I have shown and described the presently preferred embodiment of my invention, the invention is not limited thereto and may be otherwise variously practiced within the scope of the following claims:

We claim:

1. An electrical connector comprising:

a. a terminal block having threaded screw opening provided in a first surface thereof, said screw opening having a pair of longitudinally extending groves on opposite sides of a threaded cylindrical side wall of said screw opening, said terminal block having a cable opening on a surface adjacent said first surface, said cable opening extending longitudinally into said screw opening; and b. a screw member having a threaded outer surface a first end adapted to be received by the threaded screw opening, said screw member having a generally diamond shaped compression member rotatably mounted to a shaft provided on said first end, said diamond shaped compression member having two rounded corners provided on a long axis of the member, whereby when a cable is inserted into said cable opening and said first end of said screw member is inserted into said screw opening, said two rounded corners of said compression member slide in and are guided by said longitudinally extending groves as the screw member is threaded into said screw hole such that the diamond shaped compression member is moved longitudinally onto said cable compressing said cable between said compression member and a bottom surface of said screw opening to secure said cable in the terminal block with said diamond compression block restrained against rotation during rotation of said screw.

2. A connector according to claim 1 wherein said generally diamond shaped compression member also has two corners provided on a short axis of the member which freely pass through the screw opening when said screw member is threaded into said screw opening.

3. A connector according to claim 1 wherein said terminal block further comprises a female pin receptacle electrically connected to said terminal block.

4. A connector according to claim 1 wherein said screw member has a second end which has a hexagonal opening therein adapted to receive a hex key wrench.

5. A connector according to claim 1 wherein said connector is utilized to make an electrical connection between an electrical cable and information technology equipment.

6. A connector according to claim 1 wherein said generally diamond shaped compression member has a generally circular shape with said two rounded corners in the form of tabs extending on opposite sides of said member.

7. A connector according to claim 1 wherein said cable opening has a plurality of concentric groves provided therein to aid in securing the cable is said terminal block.

8. A connector according to claim 1 wherein the bottom of said screw opening is generally flat and has a plurality of transverse groves provided therein to aid in securing the cable is said terminal block.

9. A connector according to claim 1 wherein said diamond shaped compression member is rotatably attached to said shaft by means of a drive screw.

10. A connector according to claim 1 wherein said diamond shaped compression member is rotatably attached to said shaft by means of a rivet.

11. A connector according to claim 1 wherein said terminal block and said diamond shaped compression member are formed of tin plated copper and said screw is formed of stainless steel.

* * * * *